US011728554B2

(12) United States Patent
Xiong et al.

(10) Patent No.: US 11,728,554 B2
(45) Date of Patent: Aug. 15, 2023

(54) LOW-FIELD ASSEMBLED ISOLATOR

(71) Applicant: Shenzhen Huayang Technology Development Co., Ltd., Guangdong (CN)

(72) Inventors: Fei Xiong, Guangdong (CN); Wei Zhang, Guangdong (CN)

(73) Assignee: Shenzhen Huayang Technology Development Co., Ltd., Shenzhen (CN)

( * ) Notice: Subject to any disclaimer, the term of this patent is extended or adjusted under 35 U.S.C. 154(b) by 0 days.

(21) Appl. No.: 17/828,031

(22) Filed: May 30, 2022

(65) Prior Publication Data

US 2022/0294094 A1 Sep. 15, 2022

Related U.S. Application Data

(63) Continuation of application No. PCT/CN2021/075702, filed on Feb. 7, 2021.

(30) Foreign Application Priority Data

Jun. 22, 2020 (CN) ..... 202021162623.6

(51) Int. Cl.
*H01P 1/387* (2006.01)
*H01P 1/36* (2006.01)

(52) U.S. Cl.
CPC ..... *H01P 1/36* (2013.01); *H01P 1/387* (2013.01)

(58) Field of Classification Search
CPC ..... H01P 1/32; H01P 1/36; H01P 1/38; H01P 1/383; H01P 1/387; H01P 1/362; H01P 1/365; H01P 1/37; H01P 1/375; H01P 1/393; H01P 1/397; H01P 1/39
See application file for complete search history.

(56) References Cited

U.S. PATENT DOCUMENTS 5,153,537 A * 10/1992 Desmarest ..... H01P 1/387 333/1.1
2018/0166763 A1* 6/2018 Cruickshank ..... H04B 1/04

* cited by examiner

*Primary Examiner* — Stephen E. Jones

(57) ABSTRACT

The present invention discloses a low-field assembled isolator, which includes a rectangular body, wherein the body includes an upper cavity and a lower cavity which are connected in a stacked manner; gaps are formed in four side surfaces of the body through the joint surfaces of the upper cavity and the lower cavity respectively; and the isolator further includes a U-shaped magnetic circuit cover plate and two L-shaped magnetic circuit baffles; and the two L-shaped magnetic circuit baffles are respectively disposed at two corners, away from the vertical plate, of the body so as to seal the joint between two adjacent gaps. The gaps at the joint of the upper cavity and the lower cavity are effectively and fully sealed, thereby effectively preventing signal leakage and improving the performance of the low-field assembled isolator.

10 Claims, 1 Drawing Sheet

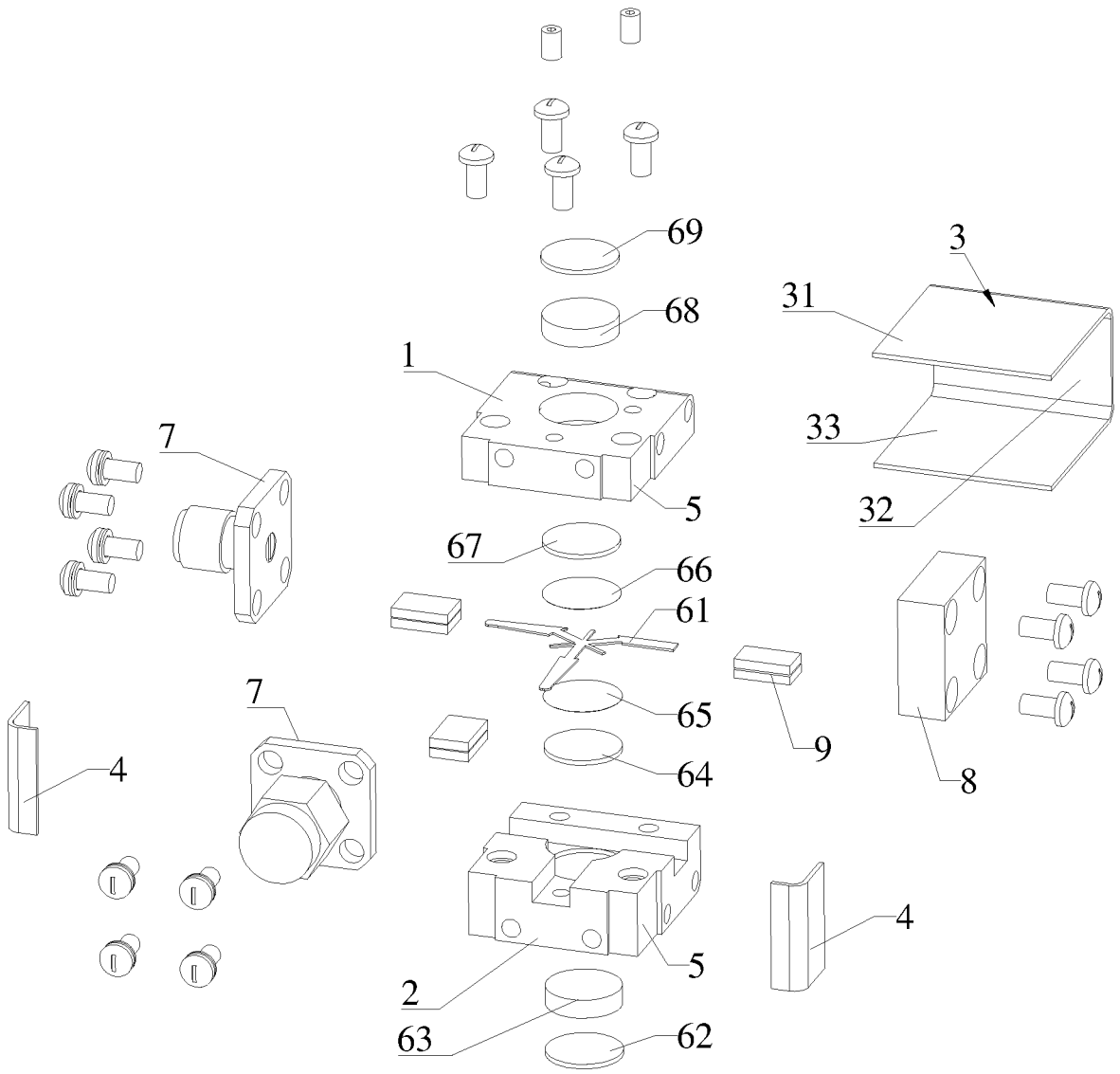
69
68
3
31
1
33
7
5
32
67
66
61
7
65
9
4
64
8
4
5
2
63
62

LOW-FIELD ASSEMBLED ISOLATOR

CROSS REFERENCE TO RELATED APPLICATIONS

The present application is a Continuation application of PCT Application No. PCT/CN2021/075702 filed on Feb. 7, 2021, which claims the benefit of Chinese Patent Application No. 202021162623.6 filed on Jun. 22, 2020. All the above are hereby incorporated by reference in their entirety.

TECHNICAL FIELD

The present invention relates to the technical field of microwave ferrite isolators, and more particularly, to a low-field assembled isolator.

BACKGROUND ART

Microwave ferrite devices (such as isolators, circulators) play the roles of circulation, isolation, and amplitude modulation in microwave circuits, and are mainly used in military radar systems and communication fields. The microwave ferrite devices have the features of preventing signal leakage to avoid mutual interference.

With the rapid development of communication technologies and market, the requirements for microwave circulators and isolators are getting higher and higher, especially the requirements for preventing signal leakage are getting higher and higher. In the past, low-field assembled coaxial isolators mostly used upper and lower magnetic circuit cover plates, but were relatively poor in their leakage resistance and could not fully meet the requirements.

SUMMARY OF THE INVENTION

Technical Problem

The technical problem to be solved by the present invention is to provide a low-field assembled isolator for preventing signal leakage.

Technical Solution

In order to solve the above-mentioned technical problem, the technical solution adopted in the present invention is summarized as follows: a low-field assembled isolator includes a rectangular body, wherein the body includes an upper cavity and a lower cavity which are connected in a stacked manner; gaps are formed in four side surfaces of the body through the joint surfaces of the upper cavity and the lower cavity respectively; a mounting member is respectively disposed on three side surfaces of the body; and the isolator further includes a U-shaped magnetic circuit cover plate and two L-shaped magnetic circuit baffles, wherein the U-shaped magnetic circuit cover plate includes an upper cover plate, a vertical plate and a lower cover plate which are connected in sequence; the upper cover plate abuts against the top surface of the body, the lower cover plate abuts against the bottom surface of the body, and the vertical plate abuts against a side surface, where no mounting member is disposed, of the body to seal the gap in this side surface; and the two L-shaped magnetic circuit baffles are respectively disposed at two corners, away from the vertical plate, of the body so as to seal the joint between two adjacent gaps.

Further, each of the L-shaped magnetic circuit baffles abuts against the two adjacent mounting members respectively.

Further, the top end of the L-shaped magnetic circuit baffle abuts against the upper cover plate, and the bottom end of the L-shaped magnetic circuit baffle abuts against the lower cover plate.

Further, the body is provided with an accommodating groove for accommodating the L-shaped magnetic circuit baffle.

Further, two oppositely arranged mounting members abut against the vertical plate respectively.

Further, the top end of each mounting member abuts against the upper cover plate, and the bottom end of the mounting member abuts against the lower cover plate.

Further, a stacking assembly is arranged in the body; the stacking assembly includes a center conductor; ports for accommodating pins of the center conductor are formed in the joint surfaces of the upper cavity body and the lower cavity body; and at least two of the mounting members are radio-frequency connectors connected to the pins of the center conductor.

Further, two radio-frequency connectors are provided, and the other mounting member is a load baffle; and a load connected to the pin of the center conductor is arranged in the port, corresponding to the load baffle, of the body.

Further, the stacking assembly includes, from bottom to top, a lower magnetic circuit board, a lower permanent magnet, a lower uniform magnetization plate, a lower microwave ferrite assembly, an upper microwave ferrite assembly, an upper uniform magnetization plate, an upper permanent magnet and an upper magnetic circuit board in sequence, wherein the center conductor is clamped between the lower microwave ferrite assembly and the upper microwave ferrite assembly.

Further, the mounting member is connected to the body via screws.

Beneficial Effects

The present invention has the following beneficial effects: according to the low-field assembled isolator, the U-shaped magnetic circuit cover plate and the L-shaped magnetic circuit baffle are matched with the mounting members, such that the gaps at the joint of the upper cavity and the lower cavity is effectively and fully sealed, thereby effectively preventing signal leakage and improving the performance of the low-field assembled isolator.

BRIEF DESCRIPTION OF THE DRAWINGS

The sole FIGURE is an exploded view of a low-field assembled isolator in Embodiment 1 of the present invention.

Reference symbols represent the following components:

1—upper cavity;

2—lower cavity;

3—U-shaped magnetic circuit cover plate; 31—upper cover plate; 32—vertical plate; 33—lower cover plate;

4—L-shaped magnetic circuit baffle;

5—accommodating groove;

61—center conductor; 62—lower magnetic circuit board; 63—lower permanent magnet; 64—lower uniform magnetization plate; 65—lower microwave ferrite assembly; 66—upper microwave ferrite assembly; 67—upper uniform magnetization plate; 68—upper permanent magnet; 69—upper magnetic circuit board;

7—radio-frequency connector;
8—load baffle; and
9—load.

DETAILED DESCRIPTION OF THE INVENTION

In order to describe the technical content, implementing objects and effects of the present invention in detail, the following description is given with reference to the embodiments and the accompanying drawings.

Referring to the sole FIGURE, a low-field assembled isolator includes a rectangular body, wherein the body includes an upper cavity 1 and a lower cavity 2 which are connected in a stacked manner; gaps are formed in four side surfaces of the body through the joint surfaces of the upper cavity 1 and the lower cavity 2 respectively; a mounting member is respectively disposed on three side surfaces of the body; and the isolator further includes a U-shaped magnetic circuit cover plate 3 and two L-shaped magnetic circuit baffles 4, wherein the U-shaped magnetic circuit cover plate 3 includes an upper cover plate 31, a vertical plate 32 and a lower cover plate 33 which are connected in sequence; the upper cover plate 31 abuts against the top surface of the body, the lower cover plate 33 abuts against the bottom surface of the body, and the vertical plate 32 abuts against a side surface, where no mounting member is disposed, of the body to seal the gap in this side surface; and the two L-shaped magnetic circuit baffles 4 are respectively disposed at two corners, away from the vertical plate 32, of the body so as to seal the joint between two adjacent gaps.

As described above, the present invention has the following beneficial effects: according to the low-field assembled isolator, the U-shaped magnetic circuit cover plate and the L-shaped magnetic circuit baffle 4 are matched with the mounting members, such that the gaps at the joint of the upper cavity and the lower cavity are effectively and fully sealed, thereby effectively preventing signal leakage and improving the performance of the low-field assembled isolator.

Further, each of the L-shaped magnetic circuit baffles 4 abuts against the two adjacent mounting members respectively.

As can be seen from the above description, no gap is formed between the L-shaped magnetic circuit baffle 4 and each mounting member, thereby improving the performance of preventing signal leakage of the low-field assembled isolator.

Further, the top end of the L-shaped magnetic circuit baffle 4 abuts against the upper cover plate 31, and the bottom end of the L-shaped magnetic circuit baffle 4 abuts against the lower cover plate 33.

As can be seen from the above description, no gap is formed between the L-shaped magnetic circuit baffle 4 and the upper cover plate, and between the L-shaped magnetic circuit baffle 4 and the lower cover plate 33, thereby improving the performance of preventing signal leakage of the low-field assembled isolator.

Further, the body is provided with an accommodating groove 5 for accommodating the L-shaped magnetic circuit baffle 4.

As can be seen from the above description, the arrangement of the accommodating groove 5 facilitates the positioning and installation of the L-shaped magnetic circuit baffle 4.

Further, two oppositely arranged mounting members abut against the vertical plate 32 respectively.

As can be seen from the above description, no gap is formed between the vertical plate 32 and the mounting member close to the vertical plate 32, thereby improving the performance of preventing signal leakage of the low-field assembled isolator.

Further, the top end of the mounting member abuts against the upper cover plate 31, and the bottom end of the mounting member abuts against the lower cover plate 33.

As can be seen from the above description, no gap is formed between each mounting member and the upper cover plate, and between the mounting member and the lower cover plate 33, thereby improving the performance of preventing signal leakage of the low-field assembled isolator.

Further, a stacking assembly is arranged in the body; the stacking assembly includes a center conductor 61; ports for accommodating pins of the center conductor 61 are formed in the joint surfaces of the upper cavity body 1 and the lower cavity body 2; and at least two of the mounting members are radio-frequency connectors 7 connected to the pins of the center conductor 61.

Further, two radio-frequency connectors 7 are provided, and the other mounting member is a load baffle 8; and a load 9 connected to the pin of the center conductor 61 is arranged in the port, corresponding to the load baffle 8, of the body.

Further, the stacking assembly includes, from bottom to top, a lower magnetic circuit board 62, a lower permanent magnet 63, a lower uniform magnetization plate 64, a lower microwave ferrite assembly 65, an upper microwave ferrite assembly 66, an upper uniform magnetization plate 67, an upper permanent magnet 68 and an upper magnetic circuit board 69 in sequence, wherein the center conductor 61 is clamped between the lower microwave ferrite assembly 65 and the upper microwave ferrite assembly 66.

Further, the mounting member is connected to the body via screws.

Embodiment 1

Referring to the sole FIGURE, Embodiment 1 of the present invention is characterized in that: a low-field assembled isolator includes a rectangular body, wherein the body includes an upper cavity 1 and a lower cavity 2 which are connected in a stacked manner; gaps are formed in four side surfaces of the body through the joint surfaces of the upper cavity 1 and the lower cavity 2 respectively; a mounting member is respectively disposed on three side surfaces of the body; and the isolator further includes a U-shaped magnetic circuit cover plate 3 and two L-shaped magnetic circuit baffles 4, wherein the U-shaped magnetic circuit cover plate 3 includes an upper cover plate 31, a vertical plate 32 and a lower cover plate 33 which are connected in sequence; the upper cover plate 31 abuts against the top surface of the body, the lower cover plate 33 abuts against the bottom surface of the body, and the vertical plate 32 abuts against a side surface, where no mounting member is disposed, of the body to seal the gap in this side surface; and the two L-shaped magnetic circuit baffles 4 are respectively disposed at two corners, away from the vertical plate 32, of the body so as to seal the joint between two adjacent gaps.

Optionally, each of the L-shaped magnetic circuit baffles 4 abuts against the two adjacent mounting members respectively; the top end of the L-shaped magnetic circuit baffle 4 abuts against the upper cover plate 31, and the bottom end of the L-shaped magnetic circuit baffle 4 abuts against the lower cover plate 33; two oppositely arranged mounting members abut against the vertical plate 32 respectively; the top end of the mounting member abuts against the upper cover plate 31, and the bottom end of the mounting member abuts against the lower cover plate 33. In this way, the U-shaped magnetic circuit cover plate 3, the two L-shaped magnetic circuit baffles 4 and the three mounting members define a box structure. Therefore, the performance of preventing signal leakage of the low-field assembled isolator is greatly improved.

Optionally, the body is provided with an accommodating groove 5 for accommodating the L-shaped magnetic circuit baffle 4. In this embodiment, the L-shaped magnetic circuit baffle 4 is connected to the body in an adhesive manner.

Further, a stacking assembly is arranged in the body; the stacking assembly includes a center conductor 61; ports for accommodating pins of the center conductor 61 are formed in the joint surfaces of the upper cavity body 1 and the lower cavity body 2; and at least two of the mounting members are radio-frequency connectors 7 connected to the pins of the center conductor 61. In this embodiment, two radio-frequency connectors 7 are provided, and the other mounting member is a load baffle 8; and a load 9 connected to the pin of the center conductor 61 is arranged in the port, corresponding to the load baffle 8, of the body. The load 9 may be optionally a carbonyl iron absorption load.

The stacking assembly includes, from bottom to top, a lower magnetic circuit board 62, a lower permanent magnet 63, a lower uniform magnetization plate 64, a lower microwave ferrite assembly 65, an upper microwave ferrite assembly 66, an upper uniform magnetization plate 67, an upper permanent magnet 68 and an upper magnetic circuit board 69 in sequence, wherein the center conductor 61 is clamped between the lower microwave ferrite assembly 65 and the upper microwave ferrite assembly 66.

The mounting member is connected to the body via screws.

In summary, according to the low-field assembled isolator, the U-shaped magnetic circuit cover plate and the L-shaped magnetic circuit baffle are matched with the mounting members, such that the gaps at the joint of the upper cavity and the lower cavity are effectively and fully sealed, thereby effectively preventing signal leakage and improving the performance of the low-field assembled isolator.

The above are only the embodiments of the present invention, and are not intended to limit the patent scope of the present invention. Any equivalent replacements made by using the contents of the description and drawings of the present invention, or directly or indirectly applied in other related technical fields, are similarly included in the scope of patent protection of the present invention.

What is claimed is:

1. A low-field assembled isolator, comprising a rectangular body, wherein the body comprises an upper cavity and a lower cavity which are connected in a stacked manner; gaps are formed in four side surfaces of the body through the joint surfaces of the upper cavity and the lower cavity respectively; mounting members are respectively disposed on three of the side surfaces of the body; and the isolator further comprises a U-shaped magnetic circuit cover plate and two L-shaped magnetic circuit baffles, wherein the U-shaped magnetic circuit cover plate comprises an upper cover plate, a vertical plate and a lower cover plate which are connected in sequence; the upper cover plate abuts against the top surface of the body, the lower cover plate abuts against the bottom surface of the body, and the vertical plate abuts against a side surface, where no mounting member is disposed, of the body to seal the gaps in this side surface; and the two L-shaped magnetic circuit baffles are respectively disposed at two corners, away from the vertical plate, of the body so as to seal the joint between two adjacent gaps.

2. The low-field assembled isolator according to claim 1, wherein each of the L-shaped magnetic circuit baffles abuts against two of the mounting members that are adjacent, respectively.

3. The low-field assembled isolator according to claim 1, wherein the top end of the L-shaped magnetic circuit baffles abut against the upper cover plate, and the bottom end of the L-shaped magnetic circuit baffles abut against the lower cover plate.

4. The low-field assembled isolator according to claim 1, wherein the body is provided with accommodating grooves for accommodating the L-shaped magnetic circuit baffles.

5. The low-field assembled isolator according to claim 1, wherein two of the mounting members are two oppositely arranged mounting members that abut against the vertical plate respectively.

6. The low-field assembled isolator according to claim 1, wherein the top end of each mounting member abuts against the upper cover plate, and the bottom end of each mounting member abuts against the lower cover plate.

7. The low-field assembled isolator according to claim 1, wherein a stacking assembly is arranged in the body; the stacking assembly comprises a center conductor; ports for accommodating pins of the center conductor are formed in the joint surfaces of the upper cavity body and the lower cavity body; and at least two of the mounting members are radio-frequency connectors connected to the pins of the center conductor.

8. The low-field assembled isolator according to claim 7, wherein two radio-frequency connectors are provided, and the other mounting member is a load baffle; and a load connected to the pin of the center conductor is arranged in the port, corresponding to the load baffle, of the body.

9. The low-field assembled isolator according to claim 7, wherein the stacking assembly comprises, from bottom to top, a lower magnetic circuit board, a lower permanent magnet, a lower uniform magnetization plate, a lower microwave ferrite assembly, an upper microwave ferrite assembly, an upper uniform magnetization plate, an upper permanent magnet and an upper magnetic circuit board in sequence, wherein the center conductor is clamped between the lower microwave ferrite assembly and the upper microwave ferrite assembly.

10. The low-field assembled isolator according to claim 1, wherein the mounting members are connected to the body via screws.

* * * * *